US005254290A

United States Patent [19]

Blandiaux et al.

[11] Patent Number: 5,254,290

[45] Date of Patent: Oct. 19, 1993

[54] HARD SURFACE CLEANER

[76] Inventors: Genevieve Blandiaux, Rue Lonhienne, 3A, B-4870 Trooz; Myriam Loth, Rue de Tilleur, 404, B-4420 Saint-Nicolas; Jean Massaux, Heids de Hansez, 80C, B-4877 Olne, all of Belgium

[21] Appl. No.: 691,621

[22] Filed: Apr. 25, 1991

[51] Int. Cl.[5] ..... C11D 1/12

[52] U.S. Cl. ..... 252/545

[58] Field of Search ..... 252/546, 545

[56] References Cited

U.S. PATENT DOCUMENTS

| | | | |
|---|---|---|---|
| 3,726,797 | 4/1973 | Sundy et al. | 252/8.8 |
| 3,741,911 | 6/1973 | Shane | 252/527 |
| 3,929,679 | 12/1975 | Cala | 252/527 |
| 3,931,033 | 1/1976 | Lohr et al. | 252/122 |
| 3,953,379 | 4/1976 | Cala | 252/527 |
| 3,959,165 | 5/1976 | Yurko | 252/109 |
| 4,017,409 | 4/1977 | Demessemaekers et al. | 252/109 |
| 4,040,989 | 8/1977 | Renaud et al. | 252/548 |
| 4,349,447 | 9/1982 | Noguchi et al. | 252/117 |
| 4,486,329 | 12/1984 | Elis et al. | 252/117 |
| 4,676,920 | 6/1987 | Culshaw | 252/163 |
| 4,827,014 | 5/1989 | Baur et al. | 558/441 |
| 5,019,296 | 5/1991 | Baur et al. | 252/546 |

FOREIGN PATENT DOCUMENTS

| | | | |
|---|---|---|---|
| 197809 | 9/1978 | Canada | 252/546 |
| 105063 | 4/1982 | European Pat. Off. . | |
| 286167 | 10/1988 | European Pat. Off. . | |
| 317542 | 5/1989 | European Pat. Off. . | |
| 1383025 | 2/1975 | United Kingdom . | |

OTHER PUBLICATIONS

Technical Information Bulletin by BASF dated Oct. 1988 for Trilon ES 9910.

*Primary Examiner*—Michael Lewis
*Assistant Examiner*—Stuart L. Hendrickson
*Attorney, Agent, or Firm*—Richard E. Nanfeldt; Bernard Lieberman; Robert Sullivan

[57] ABSTRACT

A cleaning composition is prepared including an anionic surfactant, a nonionic surfactant, a fatty acid, a water soluble organic solvent, a water insoluble organic solvent and sequestering agent of 2-hydroxy-3-aminopropionic-N,N-diacetic or its derivatives in the amount of about 2.0% to 8.0% by weight. The cleaning composition is particularly adapted for cleaning hard surfaces and is effective in degreasing and removing soap scum from kitchen and bathroom surfaces. The composition has a pH of about 8.5 to 12.5 and is particularly suited for acid sensitive surfaces.

8 Claims, No Drawings

HARD SURFACE CLEANER

FIELD OF THE INVENTION

The present invention is directed to a novel cleaning composition. More particularly, the invention is directed to a hard surface cleaner that includes an isoserine diacetate chelating agent and is effective in removing grease and soap scum from hard surfaces including acid-sensitive surfaces.

BACKGROUND OF THE INVENTION

Cleaning compositions have been commercially produced for many specific cleaning purposes. The intended surface and soil conditions often dictate the composition of the cleaner. The cleaners have been produced in both liquid and granular form, and have been formulated to perform specific cleaning tasks. For example, cleaners have been produced to clean tile floors in the kitchen or bathroom, porcelain or ceramic sinks, stainless steel, glass, painted surfaces and plastic laminates. In general, the different surfaces require specific cleaning compositions for each surface to be cleaned and it has proven difficult to produce an all purpose cleaner that is equally effective on all surfaces.

One of the more common soils in kitchens and bathrooms is soap scum formed by the reaction between a weak fatty acid and a soluble calcium salt. The calcium is typically provided in the water while the fatty acids are supplied by the soap. The insoluble fatty acid calcium salt can be removed using a detergent with a sequestering agent to form a calcium adduct that is more stable than the calcium soap. The formation of the calcium adduct is generally favored by a high pH with a calcium chelating agent. Alternatively, soap scum can be removed by an acid that is stronger than the fatty acid. The effectiveness of the reaction is generally related to the strength of the acid used for displacement of the scum.

Numerous commerically available cleaning agents have been developed to cope with and remove soap scum from kitchen and bathroom surfaces. The more effective cleaning agents include a sequestering agent such as ethylenediaminetetraacetic acid (EDTA), nitriloacetate (NTA) or N(2-hydroxyethyl) immodiacetate (HEIDA). Other cleaning formulations utilize phosphates or organic solvents to increase the cleaning effectiveness of the composition. While many of these cleaning compositions may be effective in removing soap scum, not all of the compositions are suitable for all surfaces. For example, acidic cleaning compositions cannot be used on acid-sensitive surfaces such as marble, limestone and some tiles. Other cleaning compositions that are sufficiently alkaline so as to be suitable for cleaning acid-sensitive surfaces suffer from the disadvantage of containing phosphate components. In recent years there has been increased public awareness that phosphates, as well as other components in cleaning compositions, are harmful to the environment, which has led to the development of phosphate-free detergents and cleaning compositions.

One example of a phosphate-free cleaning composition is disclosed in U.S. Pat. No. 4,349,447. The cleaning composition, as disclosed, includes an anionic or nonionic synthetic surfactant and an effective amount of a salt of imido-bis-sulfuric acid, palmitic acid and a carboxylic acid salt of N,N,-bis(carboxymethyl)glutamic acid or N,N-bis(carboxymethyl) phenylalanine. The imino-bis-sulfate is reported to have a very high pH buffering action and proper chelating ability. The palmitate is reported to have a high ability for sequestering calcium and magnesium ions and the ability to lower the zeta potential of the surfaces of dirt and fibers.

U.S. Pat. No. 3,959,165 relates to a biodegradable laundering detergent composition including a higher alkane sulfonate synthetic organic detergent, a nonionic detergent, a high $C_{10}$–$C_{18}$ fatty acid soap, sodium silicate and a carbonate. Sodium carbonate is disclosed as the main alkalizer and builder in the composition. The detergent composition is produced as a dry pulverulent material. The composition is primarily used as a laundry detergent and is not suitable as a cleaner for removing soap scum and grease soils from hard surfaces.

U.S. Pat. No. 4,486,329 relates to a single phase, liquid cleaning composition for hard surfaces. The disclosed composition includes a water-soluble mono, di, or triethanolamine or ethylenediamine salt of an anionic sulfated or sulfonated detergent, a water-soluble alkyleneoxylated nonionic detergent and a water soluble ethanolamine or ethylenediamine salt of a lower alkyl monocarboxylic acid. The cleaner is disclosed as an all-purpose cleaner with reduced streaking without rinsing.

The European Patent Application No. 317,542 relates to a hard surface cleaning composition containing an organic solvent and an iminodiacetic acid derivative and particularly N-glyceryl-imino N,N-diacetic acid. The disclosed organic solvents include alkyl benzene sulfonates, paraffin sulfonates, and ethoxylated alcohols. The cleaning composition is disclosed as having good soil-removing properties from hard surfaces.

The European Patent Application No. 105,063 relates generally to a hard surface cleaner containing a non-soap surfactant, a polyphosphate or polyphosphonate sequestering agent and an organic solvent. The preferred organic solvent is diethylene glycol mono-n-butyl ether. The cleaning composition is disclosed as being suitable for cleaning floors, greasy walls and bathtub soils when used at full strength. This composition has the disadvantage of relying on the use of phosphates as a sequestering agent, which reduces consumer acceptance of the product.

Some of the above-noted cleaning compositions have not been entirely effective in removing soap scum from bathroom and kitchen hard surfaces. Many of the previous cleaning compositions that have been used heretofore are fairly effective in removing soap scum but have the distinct drawback of utilizing phosphates or other chelating agents that are not readily biodegradable. The present invention is directed to a novel hard surface cleaning composition which overcomes the drawbacks of the previously-used cleaning compositions.

SUMMARY OF THE INVENTION

The present invention is directed to a novel phosphate-free hard surface cleaning composition. The cleaning composition provides safe cleaning of hard surfaces and particularly acid-sensitive surfaces. More particularly, the cleaning composition is adapted for use on hard surfaces such as plastic, vitreous and metal surfaces, marble and limestone. The novel cleaning composition exhibits good grease soil removal and soap scum soil removal and leaves the clean surfaces shiny without streaking or film formation. The cleaned surfaces do not require rinsing to leave the surface with a clean appearance.

The cleaning composition of the invention is an all-purpose biodegradable, aqueous cleaner that includes an effective calcium and magnesium sequestering agent so that the composition is effective in hard water. More importantly, the sequestering agent is effective in sequestering the calcium ions from soap scum formed by the calcium ions and the weak fatty acids in soaps. The cleaning composition is particularly effective in lifting soap scum from hard surfaces and dispersing the scum to be washed from the cleaned surface.

The improved cleaning composition is an aqueous mixture of an anionic surfactant, nonionic surfactant or mixtures thereof, an organic solvent and a nonphosphate sequestering agent. The sequestering agent is a 2-hydroxy-3-aminopropionic N,N-diacetic acid or a derivative thereof. In a preferred embodiment, the sequestering agent is the sodium salt of the acid. The cleaning composition exhibits good cleaning properties with little or no streaking on shiny surfaces when used full strength or diluted. The sequestering agent offers excellent sequestering of calcium and magnesium ions to effectively remove soap scum from kitchen and bathroom hard surfaces. The cleaning composition has an alkaline pH such that the composition is particularly suitable for cleaning acid-sensitive surfaces, such as marble, limestone and terrazzo.

The cleaning composition is an aqueous composition containing about 2.0 percent by weight to about 10.0 percent by weight of a surfactant selected from anionic, nonionic surfactants and mixtures thereof, about 1.0 percent to about 10.0 percent by weight of an organic solvent selected from a water soluble or water insoluble organic solvent and mixtures thereof, about 0.1% to about 5% by weight of a fatty acid or water soluble salt thereof, and about 2.0 percent to about 8.0 percent by weight of a sequestering agent selected from the group consisting of 2-hydroxy-3-aminopropionic-N,N-diacetic acid and its derivatives and the sodium salts thereof. The balance of the cleaning composition is water. The cleaning composition has a pH of about 8.5 to 12.5 and preferably about 9.5 to 11.5.

The surfactant component may be a nonionic surfactant alone although in preferred embodiments the surfactant is a mixture about 1.0% to about 8.0% by weight of an anionic surfactant and about 1.0% to 6.0% by weight of a nonionic surfactant based on the total weight of the cleaning composition. The total amount of the surfactants in the cleaning composition is from about 2.0% to 10% by weight. The organic solvent component is preferably a mixture of about 0.1% to 5.0% of a water insoluble organic solvent and about 0.5% to about 6.0% of a water soluble or water dispersible organic solvent based on the total weight of the cleaning composition. The total organic solvent content is about 1.0% to 10.0% by weight based on the total weight of the cleaning composition.

In one preferred embodiment of the invention, the cleaning composition includes about 1.0 percent to about 8.0 percent by weight of a water-soluble alkane sulfonate and/or a sodium alkyl glyceryl ether sulfate, about 1.0 percent to about 4.0 percent by weight of an ethyleneoxylated or ethoxylatedpropyleneoxylated nonionic surfactant, about 0.5 percent to 3.0 percent of coconut oil fatty acid, about 0.5 percent to 2.5 percent of an insoluble organic solvent, about 1.0 percent to 4.0 percent of a water soluble organic solvent and about 2.0 percent to 6.0 percent of trisodium 2-hydroxy-3-aminopropionic-N,N.-diacetate and the remainder water. The preferred alkane sulfonate or sulfate is sodium paraffin sulfonate or sodium lauryl ether sulfate or mixtures thereof. The nonionic surfactant is preferably a $C_9$ to $C_{11}$ ethoxylated fatty alcohol or a $C_{13}$ to $C_{15}$ ethoxylated/propoxylated fatty alcohol or mixtures thereof. The insoluble organic solvent is preferably a $C_8$ to $C_{20}$ paraffin oil, alkyl benzene or isoparaffin oil.

DETAILED DESCRIPTION OF THE INVENTION

The disadvantages and limitations of the previous cleaning compositions are obviated while providing an environmentally safe and effective cleaning composition. The invention is specifically directed to an aqueous phosphatefree biodegradable cleaning composition particularly adapted for cleaning hard surfaces and particularly acid-sensitive surfaces such as marble, limestone and terrazzo. The novel cleaning composition exhibits improved soap scum soil removal and grease soil removal from acid-sensitive surfaces compared to many previous hard surface cleaners.

The cleaning composition in a preferred embodiment includes at least one surfactant selected from the group consisting of anionic, nonionic surfactants and mixtures thereof, an organic solvent such as an organic water-insoluble hydrocarbon oil and/or a water-dispersible or water soluble organic solvent, and a sequestering agent. The sequestering agent is a narrowly defined isoserine N,N diacetic acid derivative which exhibits good sequestering characteristics of calcium and magnesium ions when used with anionic and nonionic surfactants to effectively remove soap scum soils. The composition has a pH in the range of about 8.5 to 12.5 and is safe for use on acid-sensitive surfaces. In preferred embodiments of the invention, the cleaning composition is an aqueous mixture containing about 2.0% to 10.0% by weight of at least one surfactant, about 1.0% to 10.0% of an organic solvent and about 2.0 to 8.0% sequestering agent, and about 0.1 to 5.0% of a fatty acid or salt thereof such that the composition has a pH of about 8.5 to 12.5 and preferably pH 9.5 to 11.5.

The surfactant component may be an anionic surfactant, nonionic surfactant or mixtures thereof. In the preferred embodiment of the invention the total amount of the surfactant in the cleaning composition is about 2.0% to 10.0% based on the total weight of the composition. The surfactant preferably is a mixture containing an anionic surfactant in the amount of 1.0% to 8.0% by weight, preferably 1.0% to 5.0% and a nonionic surfactant in the amount of 1.0% to 6.0%, preferably 1.0% to 4.0% and most preferably 2.0% to 4.0% based on the total weight of the composition. In embodiments of the invention the cleaning composition contains at least one nonionic surfactant and at least one anionic surfactant.

The anionic surfactants which may be used include, for example, the hydrocarbon sulfates and hydrocarbon sulfonates such as water-soluble salts of alkyl benzene sulfonates, alkyl sulfates, alkyl polyethoxy sulfates, paraffin sulfonates, alpha-olefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxyalkane-1-sulfonate, and beta-alkyloxy alkane sulfonate.

In the preferred embodiments of the invention, the anionic surfactant is a water-soluble sodium paraffin sulfonate. Paraffin sulfonates which may be used include those made by Hoechst Celanese Corp. The sodium paraffin sulfonate preferably has about 15 carbon atoms in the paraffin groups. The water-soluble paraffin sulfonates may be mixed secondary alkyl sulfonates having 10 to 20 carbon atoms per molecule with at least about 80 percent thereof being either 12 to 18 carbon atoms per molecule or 10 to 17 carbon atoms per molecule. A preferred range of carbon atom contents is from 14 to 17 carbon atoms with an average carbon content of about 15. The preferred molecular weight normally ranges from 300 to 350 g/mole.

The paraffin sulfonates are preferably prepared by the standard methods as well known in the art. Generally, a paraffin fraction corresponding to the desired chain length is subjected to the sulfoxidation process in the presence of sulfur dioxide and oxygen. The initial reaction produced is secondary sulfonic acid. The sulfonic acid is then neutralized with a suitable base to produce the secondary alkyl sulfonate. Alternatively, the secondary alkyl sulfonates may be obtained by sulfochlorination. Chlorine and sulfur dioxide are reacted with the paraffin fraction in the presence of actinic light with the resulting sulfuryl chlorides being hydrolyzed and neutralized to form the secondary alkyl sulfonate.

The higher paraffin sulfonates of 10 to 20 carbon atoms are generally sulfonated, neutralized and heated or solvent-extracted to produce a substantially pure paraffin sulfonate which is free of inorganic salts from the neutralization of sulfonic acid and sulfuric acid. In the preferred embodiments a substantially pure paraffin monosulfonate is used containing less than 5 percent sodium sulfate neutralization byproduct.

Preferably, the paraffin sulfonates are alkali metal salts of sodium or potassium. Alternatively, the paraffin sulfonates may include a cation from ammonium or lower alkanolamine. The lower alkanolamines may be mono-, di- or trialkanol group, and most preferably, ethanolamines, such as diethanolamine and triethanol amine. Magnesium and lower amines may also be used to form the water-soluble paraffin sulfonates. A preferred paraffin sulfonate is sodium paraffin sulfonate wherein 80 percent to 95 percent of the paraffin has a molecular weight of about 330 g/mole.

Other anionic surfactants which may be used are sodium $C_{10}$ to $C_{18}$ alkyl glyceryl ether sulfonates and, in particular, those produced from tallow and coconut oil, sodium coconut oil fatty acid monoglyceride sulfonates and sulfates, and sodium or potassium salts of alkyl phenol ethylene oxide ether sulfate containing about 1 to about 10 ethylene oxide units and wherein the alkyl groups contain about 8 to about 12 carbon atoms. Additional anionic surfactants include the water-soluble salts or esters of alpha-sulfonated fatty acids, linear high alkyl benzene sulfonates, higher fatty alcohol polyethoxy sulfates, the dialkyl sulfonates, alkyl phenyl polyethoxy sulfates and sulfonates. The higher fatty alkyl or acyl groups will normally be of 12 to 18 carbon atoms or 7 to 9 carbons for the middle alkyl or acyl groups. The lower alkyls and alkoxy groups generally have 2 to 4 carbon atoms. The number of alkoxy groups per molecule is from about 3 to 100, preferably from about 10 to 30. Examples of such compounds include sodium higher fatty acids monoglyceride sulfate, sodium lauryl alcohol sulfate, sodium lauryl ether sulfate, triethanol amine lauryl sulfate, sodium linear dodecyl benzene sulfonate, potassium linear n-hexadecyl benzene sulfonate, sodium lauryl N-methyl taurate, potassium stearyl alcohol polyethoxy sulfates, nonyl phenol polyethoxy sulfates, ammonium dioctyl sulfosuccinate.

In addition to the above anionic surfactants, various amine salts may also be included in the cleaning composition. Exemplary amines include ethylene diamine, ethanolamine, ethylene diamine alkyl benzene sulfonates having an alkyl of 8 to 16 carbons, ethanolamine or ethylene diamine alkyl glyceryl ether sulfates of $C_8$ to $C_{18}$ alcohols derived from tallow and coconut oil, ethanolamine or ethylene diamine $C_8$ to $C_{18}$ fatty acid monoglyceride sulfates, ethanolamine or ethylene diamine salts of sulfuric acid esters of $C_8$ to $C_{18}$ fatty alkanols and one to twelve moles of ethylene oxide, ethanolamine or ethylene diamine salts of $C_{10}$ to $C_{20}$ alkane sulfonates, ethanolamine or ethylene diaminic salts of $C_{12}$ to $C_{21}$ alkene sulfonates and ethanolamine or ethylene diamine salts of the reaction product of $C_8$ to $C_{18}$ fatty acids esterified with isothionic acid and neutralized with sodium hydroxide.

A particularly suitable amine is 2-aminoethylammonium and mono-, di-, and triethanolammonium salts of $C_8$ to $C_{16}$ alkyl benzene sulfonates and mixtures with corresponding salts of $C_{12}$ to $C_{21}$ olefin sulfonates or $C_8$ to $C_{18}$ alkyl sulfates. A suitable alkyl benzene sulfonate contains 9 to 14 carbon atoms in the alkyl group. Another suitable alkylbenzene sulfonate is a linear alkyl benzene sulfonate having a high content of 3-phenyl isomers and a low content of 2-phenyl isomers. The 2-aminoethylammonium and the diethanolammonium salts are generally preferred when an amine salt is used.

The anionic surfactant is generally included in the amount of 1.0% to 8.0% by weight and may be an organic sulfonate, organic sulfate or mixture thereof. The organic sulfonate is generally included in the amount of up to 8.0% by weight preferably 1.0% to 8.0% by weight and most preferably 1.0% to 5.0% by weight of the cleaning composition. The organic sulfate is included in the amount of up to 8.0%, preferably 1.0 to 8.0% and most preferably 1.0 to 5.0% by weight of the cleaning composition.

The nonionic organic surfactants which may be used in the cleaning compositions are organic aliphatic or alkyl aromatic hydrophobic compounds containing a terminal hydroxy group and hydrophilic ethylene oxide groups, propylene oxide groups or mixtures thereof. The surfactants are generally prepared by condensing the hydrophobic organic compound with ethylene or propylene oxide or with the polyhydration product thereof, such as polyethylene glycol. The length of the polyethyleneoxy group or polypropyleneoxy group can be adjusted to achieve the desired balance between the hydrophobic and hydrophilic elements.

The nonionic surfactants include the condensation products of a higher alkanol containing about 8 to 18 carbon atoms in a straight or branched chain configuration condensed with about 5 to 30 moles of ethylene oxide. Surfactants which may be used include, for example, condensates of dodecyl, tridecyl, tetradecyl, hexadecyl alkanols and mixtures thereof with from three to ten moles of ethylene oxide. Condensates of $C_9$ to $C_{11}$ alkanols with 5 moles of ethylene oxide, condensates of $C_8$ to $C_{10}$ alkanols with 5 moles of ethylene oxide and condensates of $C_{10}$ to $C_{14}$ alkanols with 6 moles of ethylene oxide are generally preferred.

Additional nonionic surfactants which may be used are the polyethene oxide condensates of one mole of alkyl phenol containing from about 6 to 15 carbon atoms in a straight or branched chain configuration with about 5 to 30 moles of ethylene oxide. Examples of surfactants include nonyl phenol condensed with 9 moles of ethylene oxide, nonyl phenol condensed with 12 moles of ethylene oxide, dodecyl phenol condensed with 15 moles of ethylene oxide and dinonyl phenol condensed with 15 moles of ethylene oxide. Further desirable surfactants include, for example, water-soluble condensation products of $C_{10}$ to $C_{16}$ alkanol with a heteric mixture of ethylene oxide and propylene oxide in a weight ratio of ethylene oxide to propylene oxide in the range of 5:1 to 1:5 with the total alkylene oxide content of 60 percent to 85 percent by weight of the molecule. Examples of such surfactants include $C_9$ to $C_{11}$ alkanol condensed with a mixture of 5 moles of ethylene oxide and 4 moles of propylene oxide, $C_9$ to $C_{11}$ alkanol condensed with 3 moles of ethylene oxide, $C_9$ to $C_{11}$ alkanol condensed with a mixture of 4 moles of ethylene oxide and 5 moles of propylene oxide and the condensation product of $C_{13}$ to $C_{15}$ alkanol with a mixture of 7 moles of ethylene oxide and 4 moles of propylene oxide. The ethoxy and ethoxypropoxylated fatty alcohols are generally included in the amount of 1.0 to 6.0%, preferably 1.0 to 4.0% and most preferably 2.0 to 4.0%.

The amount of the nonionic surfactant which may be used in the cleaning composition is between about 1.0% to 6.0% by weight and preferably about 1.0% to 4.0% by weight and most preferably 2.0% to 4.0% based on the weight of the cleaning composition. Generally, less than about 1 percent by weight of a nonionic surfactant does not produce a cleaning composition having good grease soil removing abilities. In one embodiment of the invention the proportion of the nonionic surfactant is determined relative to the amount of the anionic surfactant such that the weight ratio of anionic surfactant to nonionic surfactant is about 0.5:1 to about 6:1 and preferably from about 1.2:1 to about 3.5:1. This ratio has been found to exhibit good grease removing and foaming properties.

The cleaning composition preferably includes a fatty acid which is generally included in the form of a soap. The fatty acid is preferably the sodium or potassium salt one or more fatty acids. In preferred embodiments the fatty acid has a chain length of about $C_{12}$ to $C_{18}$. The fatty acids may be saturated or unsaturated. The preferred fatty acids include the natural fatty acids from coconut oil and tallow oil although other fatty acids as well known in the art may be used. The fatty acid or soap content serves to regulate foam development. The foam-inhibiting effects of the soap or fatty acid are evident when large amounts of soap are included. The soaps are easily soluble in an aqueous-alcoholic medium and can be incorporated into the cleaning composition in the form of potassium salts and the less soluble sodium salt. The soap affects the pH of the cleaning composition, which has a pH of about 8.5 to 12.5 and preferably 9.5 to 11.5. The fatty acid or fatty acid soap is generally included in the amount of 0.1% to 5% by weight preferably about 0.5% to 3.0% by weight and most preferably about 0.5% to about 2.5% by weight based on the weight of the cleaning composition.

In embodiments of the invention the soap is a tallow-coconut soap or their equivalents when tallow and coconut oil fatty acids or their corresponding fat and oil are included in the ratio of about 70:30 to 90:10 tallow-coconut. The ratio may, for example, be in the range of 75:25 to 85:15 and preferably about 4:1.

The organic solvent component of the cleaning composition preferably includes a water insoluble hydrocarbon solvent. The preferred hydrocarbon solvents are aliphatic such as the $C_8$ to $C_{20}$ paraffin oils and the $C_{10}$ to $C_{22}$ alkyl benzenes. Preferably isoparaffins having 10 to 14 carbons are provided. Examples of preferred isoparaffin oils for use in the cleaning composition are those sold under the tradenames ISOPAR G, H and L by Esso. The alkyl benzenes may be linear or branched alkyl chains. The preferred linear alkyl benzenes are those having an alkyl chain length between $C_{12}$ and $C_{20}$. The water insoluble hydrocarbon solvent is preferably included in the amount of about 0.1% to 5.0% by weight and most preferably from about 0.5% to 2.5% by weight. The water insoluble organic solvent serves primarily to boost the cleaning performance and lift soap scum from the cleaning surface.

In preferred embodiments of the invention the organic solvent component cleaning composition further includes a water soluble or water dispersible organic solvent such as alkoxyalkanols or alkoxyalkoxyalkanols 5 to 8 carbon atoms. Exemplary water soluble organic solvents include n-butoxyethanol (n-butylglycol), methoxyethoxy-ethanol (methyldiglycol), ethoxyethoxyethanol (ethyldiglycol) propoxyethoxyethanol (n-butyl diglycol and n-butoxyethoxy-ethanol). Other water soluble solvents which may be used include for example, propylene glycol n-butyl ether, benzyl alcohol, 2-ethyl-1, 3 hexanediol and 2-(2-alkoxyethoxy) ethanols where the alkoxy group is derived from ethyl, propyl or butyl and such as those sold under the tradename CARBITOL. A preferred solvent is 2(2-butoxyethoxy) ethanol. Other suitable solvents include 2 alkoxyethoxy ethanol such as those sold under the tradename CELLOSOLVE. The water soluble organic solvent may be included in the cleaning composition in the amount of about 0.5% to 6.0% by weight and preferably about 1.0% to 4.0% by weight based on the total weight of the composition.

In addition to the above solvents, other suitable water soluble solvents include alkylene glycols, glycol ethers, and alkylene acetates. Exemplary solvents include ethylene glycol mono-butyl ether, butyl acetate, amyl acetate, and butylbutyrate.

The sequestering agent according to the invention is 2-hydroxy-3-aminopropionic N, N-diacetic acid (isoserine diacetic acid) and derivatives thereof. In the preferred embodiment of the invention the sequestering agent is the sodium salt of 2-hydroxy-3-aminopropionic acid. The sequestering agent has been found to be particularly effective in removing calcium and magnesium ions as well as other alkaline earth metal and heavy metal ions. The sequestering agent has been found to have good complexing properties such that the cleaning composition is effective in removing soap scum soils from kitchen and bathroom hard surfaces. The sequestering agent may be, for example, a commercially available product sold by BASF Corp. under the tradename TRILON. The sequestering agent is included in the amount of about 2.0% to 8.0% by weight, preferably 2.0% to 6.0% and most preferably about 3.0% to 5.0% by weight based on the weight of the cleaning composition.

The isoserine diacetate is the preferred principal sequestering agent although additional sequestering agents may also be included to supplement the principal sequestering agent. Suitable auxiliary sequestering agents include, nitrilotriacetic acid, ethylenediamine tetracetic acid diethylene triaminepentacetic acid, methanediphosphonic acid, dimethylamino methane-1, 1 diphosphonic acid, aminotrimethyl-enetriphosphonic acid and 1-hydroxyethane-1, 1 diphosphonic acid.

In addition to the above components, the cleaning composition may contain optional additives to enhance specific cleaning tasks or provide desirable characteristics. The cleaning composition may contain for example buffers, stabilizer, antioxidants, bleaches, perfumes, dyes, dispersible pigments, solvents, hydrotropes, emollients, or antifoams. The composition may further contain an anti-redeposition agent such a sodium carboxymethyl cellulose, polyvinyl alcohol, polyvinyl pyrrolidone, hydroxypropylmethy cellulose, hydroxyethyl cellulose, polyacrylamides, polyacrylates, starch or gelatin derivatives.

The cleaning composition in accordance with the invention has been found to be particularly effective in removing soap scum soils and grease soils from hard surfaces. The cleaning composition is alkaline having a pH of about 8.5 to 12.5 and preferably about pH 9.5 to 11.5 such that the composition is appropriate for acid-sensitive surfaces, such as for example marble, limestone and terrazzo. The composition has been found to exhibit superior cleaning of soap scum over conventional cleaners based on alkaline buffers, such as sodium carbonate or sodium bicarbonate.

In a preferred embodiment of the invention the cleaning composition contains about 4% sodium paraffin sulfonate, about 3% of a $C_9$ to $C_{11}$ ethoxy fatty alcohol, about 0.5% coconut oil fatty acid, about 3% trisodium isoserine diacetate, about 2% isoparaffin oil, about 1% propylene glycol n-butyl ether, and the balance water, wherein the percentages are by weight of the composition. The composition has a pH of about 11.5. In an alternative preferred embodiment the cleaning composition contains about 4% sodium paraffin sulfonate, about 2% sodium lauryl ether sulfate, about 2% $C_{13}$ to $C_{15}$ ethoxy/propoxylated fatty alcohol, about 0.5% coconut oil fatty acids, about 5% trisodium isoserine diacetate, about 2% isoparaffin oil, about 3% propylene glycol n-butyl ether, and the balance water, wherein the percentages are by weight. This cleaning composition has a pH of about 10.0.

In a further embodiment, the cleaning composition may comprise about 0% to 8% of a hydrocarbon sulfate, about 0% to 8.0% of an alkyl ether sulfate, about 1.0% to 4.0% of an ethoxy fatty alcohol, about 0.5% to 3.0% of a coconut oil fatty acid, about 1.0% to 4.0% of an alkylene glycol ether and about 2.0% to 6.0% trisodium isoserine diacetate, wherein said percentages are by weight of the cleaning composition.

The cleaning performance of the novel cleaning composition is based on the grease removal and soap scum removal properties. For the grease removal evaluation of the cleaning composition a mixture of beef tallow and hardened tallow are dispersed in a solvent such as chloroform and sprayed on white formica tiles. The tiles are then allowed to dry for about one hour. The soiled tiles are then mounted in a Gardener Washability Machine equipped with two cellulose sponges measuring 5 cm by 5 cm by 5 cm. Ten milliliters of the cleaning solution of the liquid cleaning composition being tested is pipetted onto the sponge and the number of strokes required to remove the soil is determined. The cleaning solutions are evaluated in pairs and typically six replications are made for each sample and the result averaged.

The cleaning compositions are tested at full strength and as a 1.2% aqueous solution. A similar test for soap scum removal using the Gardner Washability Machine were made for each cleaning composition. The soap scum is a mixture of sodium oleate and calcium chloride sprayed on white porcelain tiles.

The following example is illustrative of the cleaning composition of the invention. Unless otherwise specified, all percentages are by weight.

EXAMPLE

A hard surface cleaning composition was prepared having the following formula. All percentages are by weight.

| Component | Sample 1 % | Sample 2 % |
|---|---|---|
| Sodium paraffin sulfonate | 4 | 4 |
| Sodium lauryl ether sulfate | — | 2 |
| $C_{9-11}$ fatty alcohol EO 5:1 | 3 | — |
| $C_{13-15}$ fatty alcohol EO 7:1 PO 4:1 | — | 2 |
| Distilled coconut oil fatty acids | 0.5 | 0.5 |
| Sodium Isoserine diacetate | 3 | 5 |
| Isopar H (trademark for isoparaffin oil) | 2 | 2 |
| Propylene glycol n butyl ether | 1 | 3 |
| Perfume/Dye | 1 | 1 |
| Water | 85.5 | 80.5 |
| pH | 11.5 ± 0.2 | 10 ± 0.2 |

The composition was prepared by dispersing the sulfonate and sulfate in water followed by the fatty acid with agitation. Thereafter the fatty alcohol was added with the isoparaffin oil and the ether. Finally the isoserine diacetate and the perfume and dye were added and the mixture agitated to form a dispersion.

The grease cleaning properties and soap scum removal properties of the cleaning composition was evaluated by comparing with other cleaning composition. The comparative cleaning samples had the following formulas wherein the percentages are by weight.

| | Comparative Sample 1 |
|---|---|
| Sodium paraffin sulfonate | 4 |
| $C_{13}$ $C_{15}$ fatty alcohol EO 7:1 PO 4:1 | 2.4 |
| Distilled coconut oil fatty acids | 0.5 |
| Diethylene Glycol monobutyl ether | 2.8 |
| Acid mixture Succinic/glutaric/adipic | — |
| Magnesium sulfate heptahydrate | 1.5 |
| Amino Trimethyl Phosphonic acid | — |
| 85% Syrupy Phosphoric acid | — |
| Di Tertiary Butyl-para-Cresol | — |
| Perfume/Dye | q.s. |
| Water | 88.8 |
| pH | 6.5 |

| | Comparative Sample 2 | Comparative Sample 3 |
|---|---|---|
| Linear alkyl benzene sulfonate | 3.6 | 0.3 |
| $C_9$ $C_{11}$ fatty alcohol EO 5:1 | 2 | 2.25 |
| Distilled coconut oil fatty acids | 0.55 | — |
| Nitrile triacetic acid | — | 2.8 |
| Sodium carbonate | 4 | 4 |
| Sodium bicarbonate | 2 | 1 |
| Sodium cumene sulfonate | — | 3.8 |
| Perfume/Dye | q.s. | q.s. |
| Water | 87.85 | 88.65 |
| pH | 10.0 | 10.0 |

The cleaning performance of the cleaning compositions were evaluated for grease removal and soap scum removal. The grease test sample was a mixture of beef tallow and hardened tallow which was sprayed on white formica tiles and allowed to dry for one hour. The soap scum was a mixture of sodium oleate and calcium chloride sprayed on white porcelain tiles and allowed to dry. The tiles were tested using a Gardener Washability Machine equipped with two cellulose sponges measuring 5 cm by 5 cm by 5 cm. Each solution was tested at full strength and at 1.2% aqueous solution. The number of strokes required to remove the grease and soap scum are as shown in Table 1. Six replications of each sample were made and the results averaged.

TABLE 1

| | Degreasing | | Soap Scum | Safety on |
|---|---|---|---|---|
| Sample | Full Strength | Diluted | Full Strength | Acid Sensitive Surfaces |
| Sample 1 | 25* | 30 | 15 | yes |
| Sample 2 | 35 | 30 | 15 | yes |
| Comparative Sample 1 | 20 | 55 | >60 | yes |
| Comparative Sample 2 | 30 | 37 | >80 | yes |
| Comparative Sample 3 | 30 | >100 | >80 | yes |

*Number of strokes.

The above data show that the cleaning composition according to the invention are effective in removing soap scum from porcelain surfaces without sacrificing grease removal performance. The comparative samples were effective in removing grease when used full strength but were not effective in removing the soap scum. The novel cleaning composition of Sample 1 and Sample 2 exhibited superior soap scum removal compared to Comparative Samples 2 and 3 based on sodium carbonate and sodium bicarbonate.

What is claimed is:

1. A phosphate-free hard surface aqueous cleaning composition consisting of approximately by weight:

(a) 2 to 10 percent of a surfactant system consisting of a mixture of 1 to 8 percent of an anionic surfactant and 1 to 6 percent of a nonionic surfactant, wherein said nonionic surfactant is selected from the group consisting of ethoxylated fatty alcohols and ethoxylated/propoxylated fatty alcohols and mixtures thereof and said anionic surfactant is selected from the group consisting of ethoxylated fatty alcohols and ethoxylated/propoxylated fatty alcohols and mixtures thereof and said anionic surfactant is selected from the group consisting of water soluble alkane sulfonates, having 10 to 20 carbon atoms alkali metal salts of said sulfonates alkyl glycerol ether sulfonates having 10 to 18 carbon atoms, alkali metal salt of said alkyl glycerol ether sulfonates, paraffin sulfates having 10 to 18 carbon atoms, alkyl ether sulfates having 12 to 18 carbon atoms and mixtures thereof;

(b) a solvent system consisting of a mixture of 0.1 to 5.0 percent of a water insoluble hydrocarbon solvent being selected from the group consisting of $C_{8-20}$ paraffins and $C_{8-20}$ isoparaffins and mixtures thereof and 0.5 to 6.0 percent of a water soluble or water dispersible solvent which is selected from the group consisting of alkyoxyalkanols, alkoxyalkoxy-alkanols, alkylene glycol, glycol ethers and alkylene acetates and mixtures thereof;

(c) 0.5 to 3.0 percent of a fatty acid having about 12 to about 18 carbon atoms;

(d) 2.0 to 8.0 percent of a sequestering agent selected from the group consisting of 2-hydroxy-3-aminopropionic-N,N diacetic and alkali metal salts of 2-hydroxy-3-aminopropionic-N,N-diacetic acid; and (e) the balance being water, wherein said cleaning composition has a pH of about 8.5 to 12.5.

2. The cleaning composition of claim 1, wherein said water soluble solvent is propylene glycol n-butyl ether.

3. The cleaning composition of claim 2, wherein said fatty acid is a coconut oil fatty acid.

4. The cleaning composition of claim 1 wherein said water insoluble hydrocarbon solvent is an isoparaffin hydrocarbon.

5. The cleaning composition of claim 1 wherein said water soluble solvent is a water soluble alkylene glycol alkyl ether.

6. The cleaning composition of claim 1 containing about 3.0% to 5.0% by weight of said sequestering agent.

7. The cleaning composition of claim 1 wherein said fatty acid is a coconut oil fatty acid.

8. The cleaning composition of claim 1 wherein said composition has a pH of about 9.5 to 11.5.

* * * * *